United States Patent [19]

Yoshida et al.

[11] Patent Number: 5,006,017

[45] Date of Patent: Apr. 9, 1991

[54] METHOD FOR IMPROVING GROUND OF LARGE SECTION AREA

[75] Inventors: Hiroshi Yoshida, Tokorozawa; Mitsuhiro Shibazaki, Tokyo; Hiroaki Kubo, Nakamuraminami; Shunji Jinbo, Koyama, all of Japan

[73] Assignees: Kajima Corporation; Chemical Grouting Company, Ltd., both of Tokyo, Japan

[21] Appl. No.: 471,488

[22] Filed: Jan. 29, 1990

[30] Foreign Application Priority Data

Jan. 27, 1989 [JP] Japan ..... 1-16320

[51] Int. Cl.[5] ..... E02D 3/12

[52] U.S. Cl. ..... 405/263; 405/266; 405/269

[58] Field of Search ..... 166/222, 223, 285; 405/258, 263–269

[56] References Cited

U.S. PATENT DOCUMENTS

| | | | |
|---|---|---|---|
| 4,084,648 | 4/1978 | Yahiro et al. | 175/67 |
| 4,624,606 | 11/1986 | Nakanishi et al. | 405/269 |
| 4,786,212 | 11/1988 | Bauer et al. | 405/269 |

FOREIGN PATENT DOCUMENTS

| | | | |
|---|---|---|---|
| 305235 | 4/1918 | Fed. Rep. of Germany | 405/269 |
| 24052 | 6/1981 | Japan | 405/269 |
| 57-38728 | 8/1982 | Japan . | |
| 27364 | 6/1983 | Japan | 405/269 |
| 1122829 | 11/1984 | U.S.S.R. | 405/258 |

*Primary Examiner*—Randolph A. Reese
*Assistant Examiner*—John A. Ricci
*Attorney, Agent, or Firm*—Beveridge, DeGrandi & Weilacher

[57] ABSTRACT

The present invention relates to a method of improving the ground of a large section area. A double pipe, having a first nozzle directed in the lateral direction and a second nozzle surrounding the first nozzle, is inserted into a hole dug in the ground. A ground improving agent is injected at high pressure from the first nozzle through one pipe of the double pipe. A reproduced slurry, obtained by reproducing grouted slimes, is injected from the second nozzle through the other pipe of the double pipe at a lower pressure than the pressure of the ground improving agent. While rotating, the double pipe is lifted up from under ground. The ground improving agent, injected at the high pressure, is surrounded by the reproduced slurry injected at the lower pressure. The frictional resistance between the ground improving agent and the sediments is reduced, the arrival distance of the ground improving agent is increased, and the abrasive effect is obtained. Instead of surrounding the first nozzle, the second nozzle can be arranged at a position closer to the first nozzle. Further, a triple pipe, having the first and second nozzles and a third nozzle surrounding the first and second nozzles, can be inserted into the hole dug in the ground. The ground improving agent is injected at high pressure from the first nozzle through a first pipe in the triple pipe. The reproduced slurry, obtained by reproducing the grouted slimes, is injected from the second nozzle through a second pipe in the triple pipe at a lower pressure than the pressure of the ground improving agent. A gas is blown out from the third nozzle through a third pipe in the triple pipe. While rotating, the triple pipe is lifted up from under the ground. Both the ground improving agent injected at the high pressure and the reproduced slurry injected at the lower pressure are surrounded by the gas. This method results in reproduction of the grouted slimes, assurance of the necessary injection amount of the grouting ground improving agent, and suitabloe jet stream dynamic pressure distribution.

3 Claims, 7 Drawing Sheets

METHOD FOR IMPROVING GROUND OF LARGE SECTION AREA

FIELD OF THE INVENTION

The present invention relates to a method for improving a ground area. More particularly, the invention relates to a method for improving a large section ground area having a large diameter by injecting a ground improving agent (such as a cement milk, etc.) by means of a super high pressure jet stream system.

DESCRIPTION OF THE BACKGROUND ART

Examples of typical ground improving methods include a jet grouting method and a chemical churning piling method. According to the jet grouting method, a ground area is dug and grouted using a super high pressure jet water and an air surrounding the jet water. A ground injecting agent is injected and filled into a space dug and grouted by the jet water and air. This method has advantages such that the arrival distance of the jet water is extended and the ground can be grouted over a wide range (large section area). However, since the grouted slimes are blown up onto the ground due to the lifting operation of the air, a problem arises because the grouted slimes, blow up onto the ground, should be properly treated. Also, if cement milk is used as a ground improving agent, a problem arises such that part of the cement milk is blown up onto the ground and a secondary environmental pollution is caused due to the alkalinity of cement.

On the other hand, in the chemical churning piling method, the ground improving agent is injected into the ground at a high pressure, the ground is dug and grouted by the destructive power thereof, and a consolidation body of the ground improving agent is constructed in the ground. Since no air is used, no grouted slime is blown up onto the ground. Thus, the problem of treatment of the grouted slimes etc. does not occur. However, a drawback occurs because the arrival distance of the ground improving agent is relatively short and the ground cannot be grouted over a wide range.

The applicant has already proposed a ground improving method in which a ground improving agent (such as cement milk, cement bacillus, or the like), injected at a high pressure, is surrounded by a liquid (such as water) which is injected at a lower pressure. Frictional resistance between the ground improving agent and the sediments is reduced, thereby increasing the arrival distance of the ground improving agent.

The above-mentioned method itself is effective. However, in the case of using only an amount of jet stream which is the same as an amount of ground improving agent necessary for grouting, a problem arises because the amount of jet stream will be less than a necessary injection amount of the improved consolidation body of a large area. In addition, it is generally necessary to immediately throw away grouted slimes after the ground improving agent has been used. The costs for throwing away these slimes are expensive.

Examples of conventional techniques have been proposed in U.S. Pat. No. 4,084,648, entitled "PROCESS FOR THE HIGHPRESSURE GROUTING WITHIN THE EARTH AND APPARATUS ADAPTED FOR CARRYING OUT SAME", and U.S. Pat. No. 4,047,580, entitled "HIGH-VELOCITY JET DIGGING METHOD".

SUMMARY OF THE INVENTION

It is an object of the present invention to provide a method for improving a large section ground area in which grouted slimes are used as an additive injection agent so that resources are effectively used and an improved consolidation body of large section area and good quality is obtained.

According to the present invention, a double pipe having a first nozzle at a top and a second nozzle surrounding the first nozzle is inserted into a previously-formed hole in the ground. A ground improving agent is injected at high pressure from the first nozzle through one pipe of the double pipe, and a reproduced slurry, obtained from reproducing grouted slimes, is injected from the second nozzle through the other pipe of the double pipe at a pressure lower than the pressure of the ground improving agent. While rotating, the double pipe is drawn up from under the ground, and the ground improving agent, injected at a high pressure, is surrounded by the reproduced slurry injected at a lower pressure, thereby reducing frictional resistance between the ground improving agent and sediments, increasing arrival distance of the ground improving agent, and functioning an abrasive effect.

Also, according to the present invention, a double pipe having a first nozzle at a top and a second nozzle arranged closely to the first nozzle is inserted into a hole previously formed in the ground. A ground improving agent is injected at a high pressure from the first nozzle through one pipe of the double pipe, and a reproduced slurry, obtained from reproducing grouted slimes, is injected from the second nozzle through the other pipe of the double pipe at a pressure lower than the pressure of the ground improving agent. While rotating, the double pipe is drawn up from under the ground, and the reproduced slurry, injected at a lower pressure than the pressure of the ground improving agent, is injected along with the ground improving agent, thereby reducing frictional resistance between the ground improving agent and sediments, increasing arrival distance of the ground improving agent, and functioning an abrasive effect.

Furthermore, according to the present invention, a triple pipe, having first and second nozzles directed in a lateral direction at a top and a third nozzle surrounding the first and second nozzles, is inserted into a hole previously formed in the ground. A ground improving agent is injected at a high pressure from the first nozzle through a first pipe in the triple pipe, and a reproduced slurry, obtained from reproducing grouted slimes, is injected from a second nozzle through the second pipe in the triple pipe at a pressure lower than the pressure of the ground improving agent. A gas is injected from the third nozzle through a third pipe in the triple pipe. While rotating, the triple pipe is drawn up from the underground, and both the ground improving material injected at relatively high pressure and the reproduced slurry injected at relatively lower pressure are surrounded by the gas. In this case, the second nozzle may be arranged to surround the first nozzle and/or arranged closely to the first nozzle. Upon reproduction of the grouted slimes, the sand component preferably remains in the reproduced slurry.

In the large-section area, ground-improving method discussed above, the dynamic pressure in a jet axis direction of the ground improving agent decreases due to the velocity difference in a boundary portion between the ground improving agent jet stream and the reproduced slurry jet stream. As a result, a gently jet stream dynamic pressure distribution is obtained. Thus, the grouting width of the jet stream is widened, and the jet stream dynamic pressure, being stronger than needed for digging the ground, does not function on the grouting operation of the ground. Since the amount of grouting injection is increased by the amount of the reproduced slurry, the necessary grouting injection amount is assured, and an improved consolidation body of uniform quality and large section area is derived.

Also, the reproduced slurry comprising the sand component and the ground improving agent are mixed in a front edge portion (top portion), the abrasive effect is functioned, and the grouting effect is improved. These effects contribute to the formation of the improved consolidation body of a large section area.

Finally, if the ground improving agent and the reproduced slurry are surrounded by a gas such as compressed air, upon injections thereof, the frictional resistance between the ground improving agent and the sediments is further decreased, and the arrival distance of the ground improving agent is further increased. The abrasive effect functioned by the ground improving agent and the reproduced slurry is efficient.

DETAILED DESCRIPTION OF THE PREFERRED EMBODIMENTS

Figure 1:
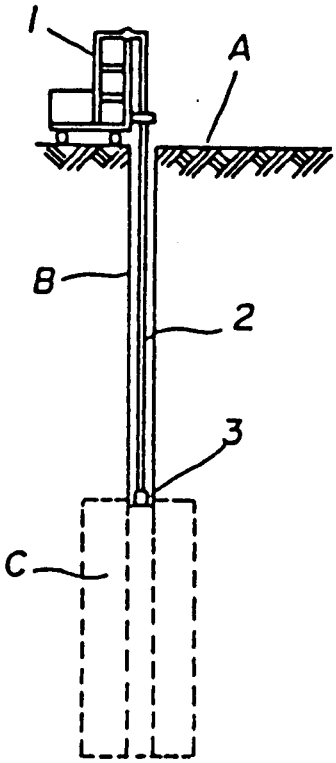
FIG. 1 is a diagram showing a ground improved layer formed in the underground by a method according to the present invention.

FIG. 1 shows a working machine 1 installed adjacent to a hole B previously dug in ground A. A double pipe 2 is inserted into the hole B. A ground improving agent, such as cement milk, cement bacillus, or the like, is supplied through the pipe 2 from a double nozzle 3 provided at a top portion of the pipe 2. The ground improving agent and a reproduced slurry, obtained by reproducing a grouted slurry surrounding the ground improving agent and comprising the sand component remaining upon reproduction, are injected in a direction perpendicular to the axial-line direction of the pipe 2, thereby resulting in digging and grouting of the ground A. Afterward, the pipe 2 is drawn up while rotating by the working machine 1. In this manner, a cylindrical improved consolidation body C of the ground is formed in the underground.

Figure 2:
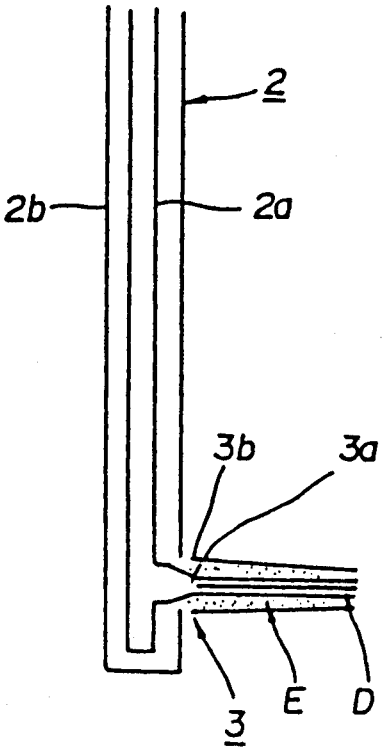
FIG. 2 is a side sectional view of a nozzle portion showing jet streams injected from nozzles according to the present invention.

FIG. 2 shows a portion of the nozzle 3 of the pipe 2. The pipe 2 is constructed as a double pipe including an inside pipe 2*a* and an outside pipe 2*b*. A first high pressure nozzle 3*a* is provided at a top portion of the inside pipe 2*a*. A jet stream of a ground improving agent D is injected from the first nozzle 3*a* at a high pressure of ordinarily 300 to 400 kg/cm$^2$. Also, a second low pressure nozzle 3*b* is provided at a top portion of the outside pipe 2*b* so as to surround the first nozzle 3*a*. A reproduced slurry jet stream E is injected from the second nozzle 3*b* at a pressure of ordinarily 10 to 30 kg/cm$^2$. This value is lower than the pressure of the ground improving agent D so as to surround the ground improving agent D injected at a high pressure.

Figure 3:
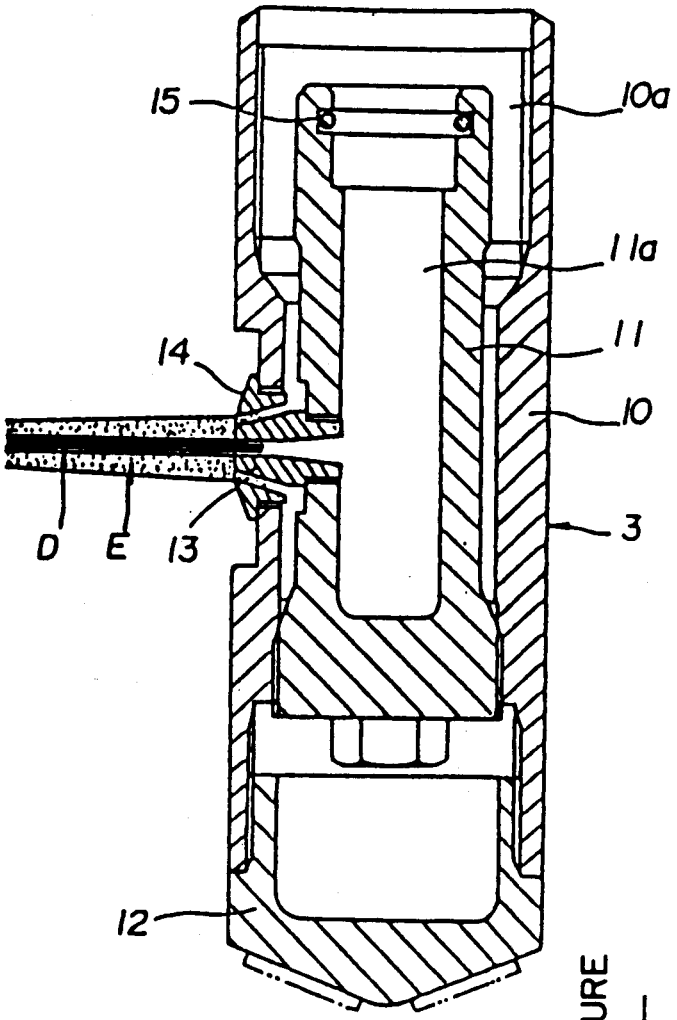
FIG. 3 is a side sectional view showing details of nozzles used in the method according to the present invention.

FIG. 3 shows the details of the nozzle 3. An injector 11 is threadably attached into a cylindrical body 10. A noncore bit 12 is threadably attached to a top portion of the body 10. A first nozzle 13 (shown as the nozzle 3*a* in FIG. 2) is threadably attached to the injector 11. A second nozzle 14 (shown as the nozzle 3*b* in FIG. 2) is threadably attached to the cylindrical body 10 so as to surround the first nozzle 13.

A double pipe (not shown) is threadably attached to the body 10. The inside pipe (shown as the pipe 2*a* in FIG. 2) of the double pipe is hermetically held by an O-ring 15 and is coupled to the injector 11 (passageway thereof is shown by 11*a*). The outside pipe (shown as the pipe 2*b* in FIG. 2) of the double pipe is coupled to a passageway 10*a* which is formed by the inner peripheral wall of the cylindrical body 10 and the outer peripheral wall of the injector 11. Therefore, the ground improving agent D, such as cement milk, cement bacillus, or the like, supplied through the inside pipe 2*a* of the double pipe is injected from the first nozzle 13 at a high pressure. Also, reproduced slurry supplied through the outside pipe 2*b* of the double pipe is injected as a reproduced slurry jet stream E from the second nozzle 14 at a pressure lower than the pressure of the ground improving agent D so as to surround the ground improving agent D. In this case, the nozzles 13 and 14 are rotated by rotating the double pipe and, at the same time, they are lifted up by the working machine 1 shown in FIG. 1.

When embodying the present invention, first, as shown in FIG. 1, the hole B is dug at a predetermined position of the ground A by a well-known method. Afterward, the pipe 2, having the nozzle 3 attached at the top portion, is inserted into the hole B by the working machine 1. As mentioned above, the bit 12 (shown in FIG. 3) is attached to the top of the nozzle 3. Thus, even if the sediments collapse, the pipe 2 can be easily inserted to the lower end of the hole B by rotating the pipe 2.

As shown in FIG. 2, the jet stream of the ground improving agent D (such as cement milk, cement bacillus, or the like) is injected at a relatively high pressure from the first nozzle 3*a* (shown as the nozzle 13 in FIG. 3) through the inside pipe 2*a* of the pipe 2. Also, the reproduced slurry jet stream E is injected from the second nozzle 3*b* (shown as the nozzle 14 in FIG. 3) through the outside pipe 2*b* of the pipe 2 at a relatively lower pressure than the pressure of the ground improving agent D. The pipe 2 is lifted up while rotating the nozzles 3*a* and 3*b* by rotating the pipe 2 by the working machine 1. Thus, the ground A is dug and grouted and, at the same time, both the ground improving agent and the reproduced slurry are injected so that the improved consolidation body C of the cylindrical ground of a large section area is formed.

Since the jet stream of the ground improving agent D of a high pressure is injected and surrounded by the reproduced slurry jet stream E of a low pressure, the frictional resistance between the ground improving agent and the sediments is decreased, and the arrival distance of the jet stream of the ground improving agent D is remarkably increased. As a result, the ground is improved over a wide range.

Figure 4:
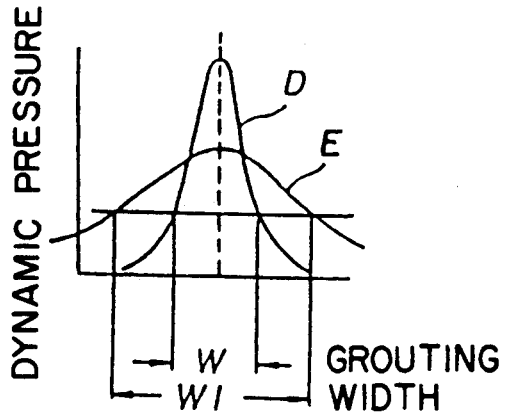
FIG. 4 is a graph showing relationships between grouting width and dynamic pressure.
Figure 5A:
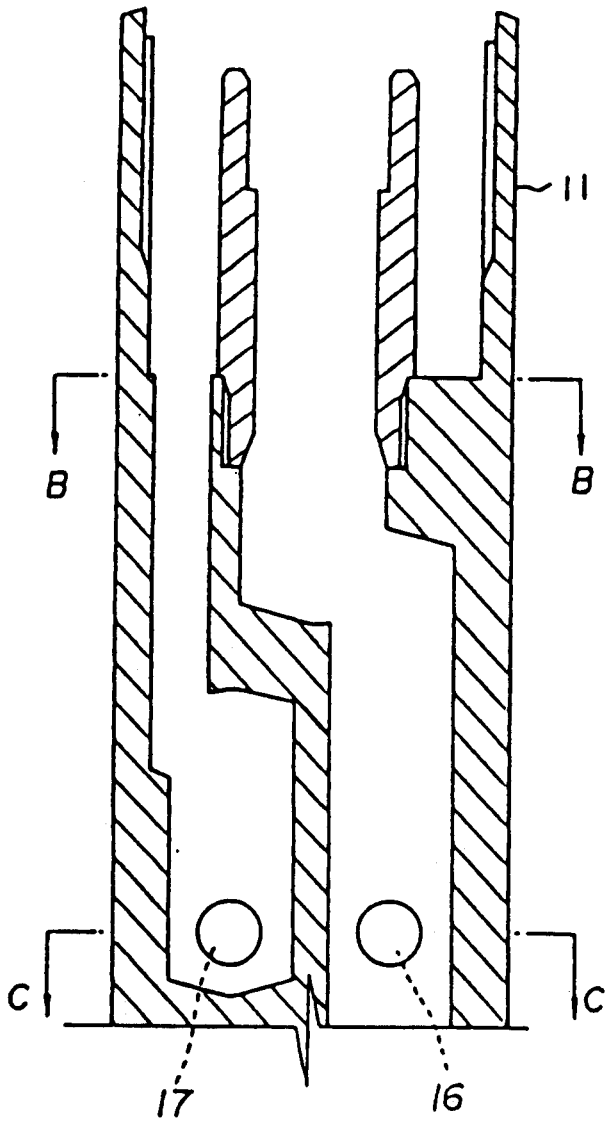
FIGS. 5A to 5D are side sectional views showing details of nozzles used in another embodiment of a method according to the present invention.
Figure 5B:
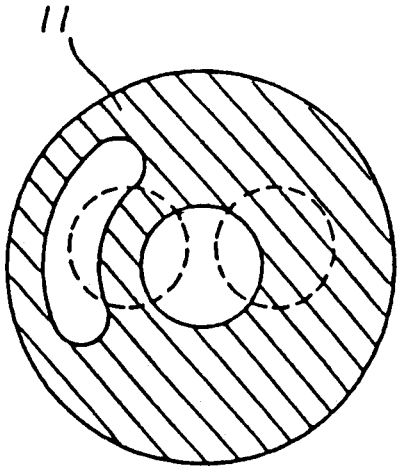
Figure 5C:
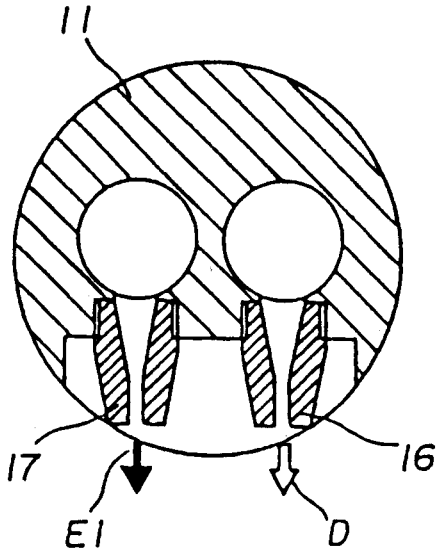
Figure 5D:
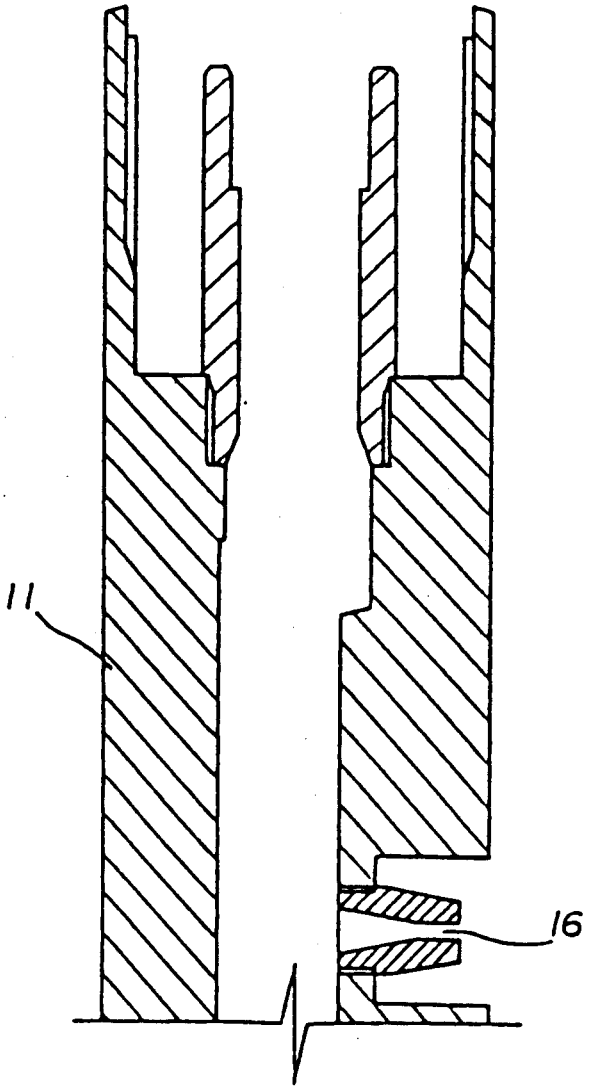

Also, the dynamic pressure in the axis direction of the jet stream D of the ground improving agent is decreased due to the velocity difference in the boundary portion between the ground improving agent jet stream D and the reproduced slurry jet stream E. As shown in FIG. 4, as compared with the case of the ground improving agent D, a gentle dynamic pressure distribution as shown in the case of jet streams D+E is obtained. Therefore, the grouting width of the jet stream is widened from W to $W_1$ and, at the same time, the jet stream dynamic pressure, being stronger than needed for grouting, does not function on the grouting operation of the ground. Thus, an improved consolidation body of uniform quality is formed.

The ground improving agent jet stream D and the reproduced slurry jet stream E containing the sand component are mixed in the top portion. Thereby, the grouting capability is enhanced due to the abrasive effect of the sand component and contributes to form the improved consolidation body of a large diameter.

FIGS. 5A to 5D show another embodiment of a method according to the present invention. A nozzle body is threadably attached to the injector 11 and cylindrical body 10. A first nozzle 16 and a second nozzle 17, arranged closely to the first nozzle 16, are provided in the nozzle body. A ground improving agent jet stream is injected from the first nozzle 16 at a high pressure. A reproduced slurry jet stream $E_1$, having an injection pressure which is relatively low, is injected from the second nozzle 17 along the upper surface of the jet stream D. This embodiment operates to achieve effects substantially similar to those in the first embodiment.

Figure 6:
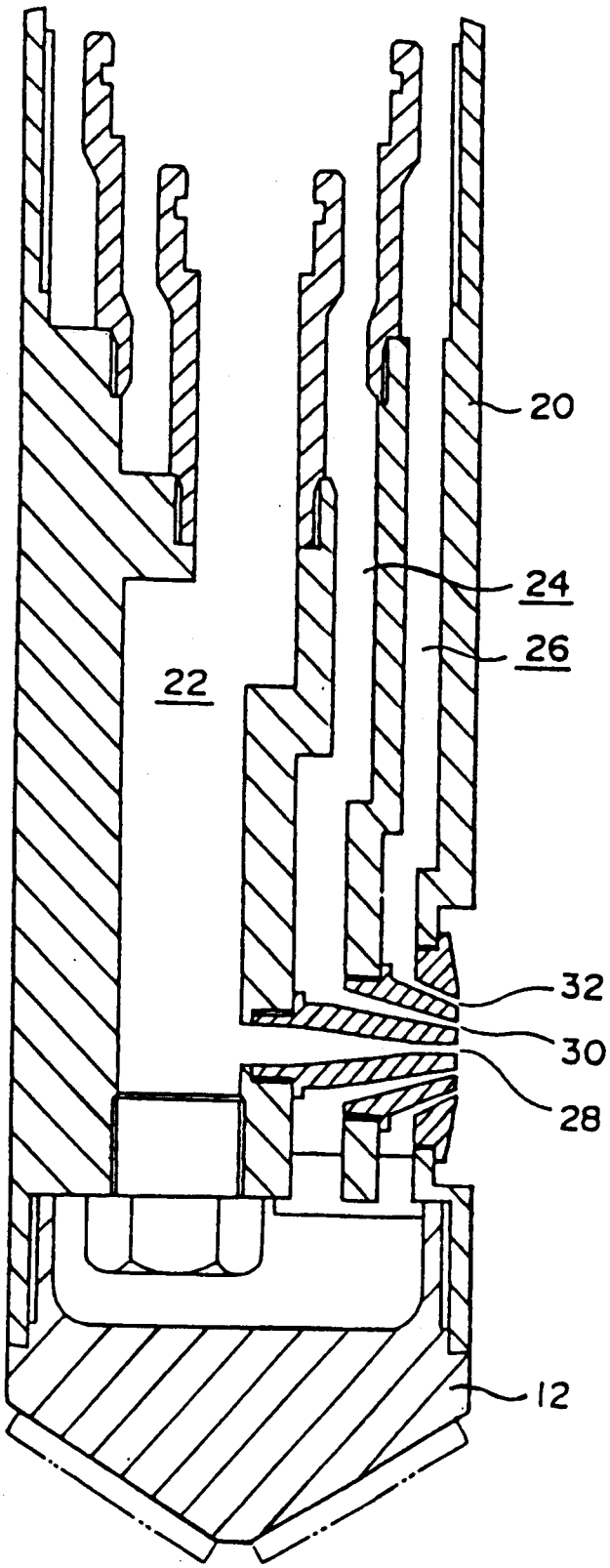
FIG. 6 is a vertical sectional view showing another embodiment of the present invention.

FIG. 6 shows parts and/or components used in still another embodiment of a method according to the present invention. A cylindrical body 20, coupled to a triple pipe (not shown), has therein a first pipe 22, a second pipe 24, and a third pipe 26. The first pipe 22 is communicated with a first nozzle 28, the second pipe 24 is communicated with a second nozzle 30, and the third pipe 26 is communicated with a third nozzle 32. The third nozzle 32 is provided so as to surround the first and second nozzles 28 and 30, respectively.

A ground improving agent flows in the first pipe 22. A reproduced slurry flows in the second pipe 24. A gas (for example, compressed air) flows in the third pipe 26. The ground improving agent is injected from the first nozzle 28 at a high pressure. The reproduced slurry is injected from the second nozzle 30 at a pressure lower than the pressure of the ground improving agent so as to surround the jet stream of the ground improving agent. The compressed air is blown out from the third nozzle 32 so as to surround the jet stream of the ground improving agent and the jet stream of the reproduced slurry.

Figure 7:
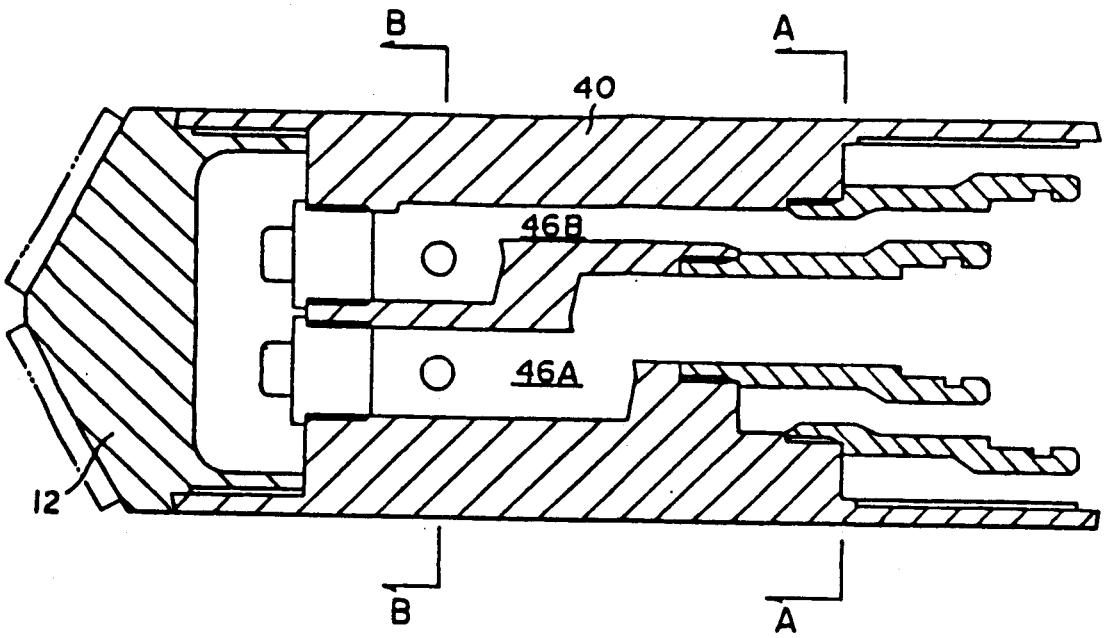
FIG. 7 is a vertical sectional view showing another embodiment of the invention.
Figure 8:
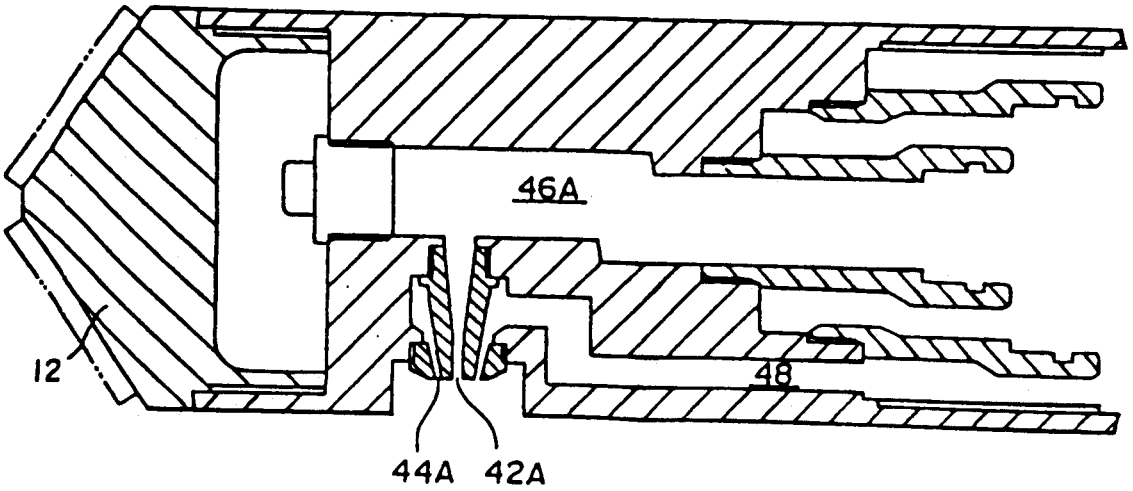
FIG. 8 is a vertical sectional view showing another sectional view different from FIG. 7.
Figure 9:
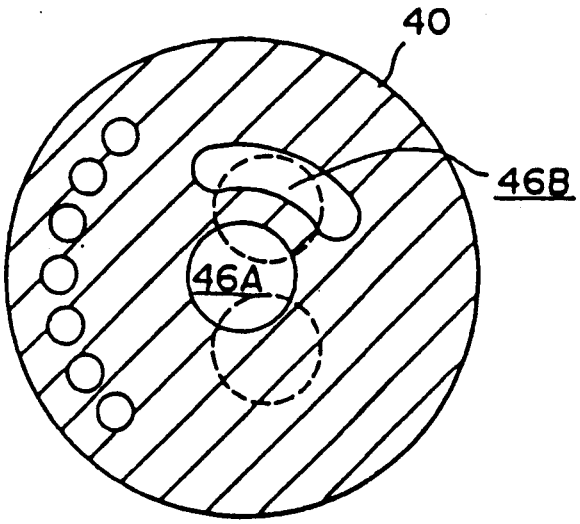
FIG. 9 is a cross sectional view taken along the line A—A in FIG. 7.
Figure 10:
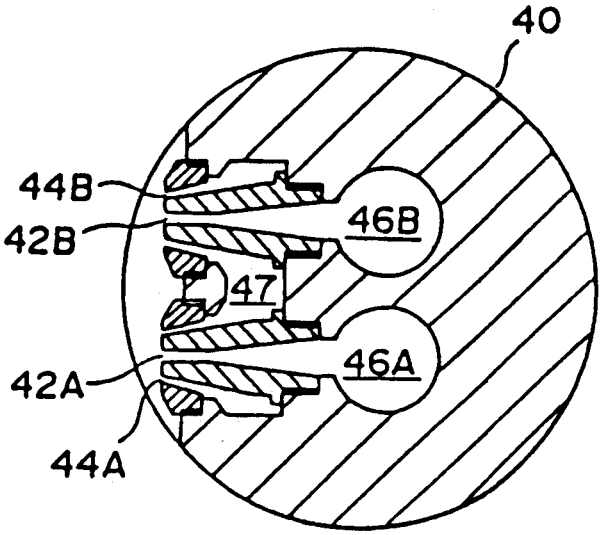
FIG. 10 is a cross sectional view taken along the line B—B in FIG. 7.

FIGS. 7 to 10 show another embodiment of a method according to the present invention. As shown in FIGS. 7 to 9, two first nozzles 42A and 42B and two second nozzles 44A and 44B are respectively provided in a cylindrical body 40. The first nozzles 42A and 42B are respectively communicated with first pipes 46A and 46B for the ground improving agent. The second nozzles 44A and 44B are communicated with a second pipe 48 for the reproduced slurry through a chamber 47.

The ground improving agents flowing in the first pipes 46A and 46B are injected from the first nozzles 42A and 42B, respectively, On the other hand, the reproduced slurries are injected from the second nozzles 44A and 44B through the second pipe 48 and the chamber 47 at a pressure lower than the pressure of the ground improving agent jet stream so that the reproduced slurry jets respectively surround the two jet streams of the ground improving agents.

As a result of the present invention, the grouted slimes are reproduced and used, the necessary injection amount of the grouting ground improving agent is assured, and the jet stream dynamic pressure distribution can be made smooth (can be suitable). Also, by the abrasive effect, an improved consolidation body of uniform quality and large section area is formed and the ground can be improved over a wide range.

What is claimed is:

1. A method for improving a large-section ground area comprising the steps of:

inserting a double pipe into a hole previously dug in the ground, said double pipe having a first nozzle at a top portion directed in a lateral direction and a second nozzle surrounding said first nozzle;

injecting a ground improving agent at a high pressure from said first nozzle through one pipe of said double pipe;

injecting a reproduced slurry, obtained by reproducing grouted slimes, from said second nozzle through another pipe of said double pipe at a pressure lower than said pressure of said ground improving agent;

lifting said double pipe up from under the ground while rotating said double pipe; and surrounding said ground improving agent with said reproduced slurry to thereby reduce frictional resistance between said ground improving agent and sediments, increase arrival distance of said ground improving agent, and obtain an abrasive effect.

2. A method for improving a large-section ground area comprising the steps of:

inserting a double pipe into a hole previously dug in the ground, said double pipe having a first nozzle at a top portion directed in a lateral direction and a second nozzle located near said first nozzle;

injecting a ground improving agent at a high pressure from said first nozzle through one pipe of said double pipe;

injecting a reproduced slurry, obtained by reproducing grouted slimes, from said second nozzle through another pipe of said double pipe at a pressure lower than said pressure of said ground improving agent;

lifting said double pipe up from under the ground while rotating said double pipe; and injecting said reproduced slurry along with said ground improving agent to thereby reduce frictional resistance between said ground improving agent and sediments, increase arrival distance of said ground improving agent, and obtain an abrasive effect.

3. A method for improving a large-section ground area comprising the steps of:

inserting a triple pipe into a hole previously dug in the ground, said triple pipe having first and second nozzles at a top portion directed in a lateral direction and a third nozzle surrounding said first and second nozzles;

injecting a ground improving agent at a high pressure from said first nozzle through a first pipe in said triple pipe;

injecting a reproduced slurry, obtained by reproducing grouted slimes, from said second nozzle through a second pipe in said triple pipe at a pressure lower than said pressure of said ground improving agent;

injecting a gas from said third nozzle through a third pipe in said triple pipe;

lifting said triple pipe up from under the ground while rotating said triple pipe; and surrounding said ground improving agent and said reproduced slurry by means of said gas.

* * * * *